US007784920B2

(12) United States Patent
Sugahara et al.

(10) Patent No.: US 7,784,920 B2
(45) Date of Patent: Aug. 31, 2010

(54) LIQUID-DROPLET JETTING APPARATUS AND LIQUID TRANSPORTING APPARATUS

(75) Inventors: Hiroto Sugahara, Aichi-ken (JP); Hiroyuki Ishikawa, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 544 days.

(21) Appl. No.: 11/441,169

(22) Filed: May 26, 2006

(65) Prior Publication Data

US 2006/0268075 A1 Nov. 30, 2006

(30) Foreign Application Priority Data

May 26, 2005 (JP) ..... 2005-153904

(51) Int. Cl.
*B41J 2/045* (2006.01)

(52) U.S. Cl. ..... 347/68

(58) Field of Classification Search ..... 347/68–72
See application file for complete search history.

(56) References Cited

U.S. PATENT DOCUMENTS

| | | | | |
|---|---|---|---|---|
| 4,459,601 | A | 7/1984 | Howkins | |
| 4,509,059 | A | 4/1985 | Howkins | |
| 4,646,106 | A | 2/1987 | Howkins | |
| 4,697,193 | A | 9/1987 | Howkins | |
| 5,943,079 | A | 8/1999 | Yoshida | |
| 2003/0156165 | A1 * | 8/2003 | Sakaida | 347/68 |
| 2003/0210306 | A1 * | 11/2003 | Takahashi et al. | 347/68 |

FOREIGN PATENT DOCUMENTS

| | | |
|---|---|---|
| JP | 1990266952 | 10/1990 |
| JP | 199271712 | 11/1992 |
| JP | 1997141856 | 6/1997 |

* cited by examiner

*Primary Examiner*—An H Do
(74) *Attorney, Agent, or Firm*—Baker Botts L.L.P.

(57) ABSTRACT

An ink-jet head includes a channel unit in which two sets of a manifold and five pressure chambers adjacent to the manifold are formed, a vibration plate which is provided on an upper surface of the channel unit, a piezoelectric layer which is provided on an upper surface of the vibration plate, and a piezoelectric actuator which includes individual electrodes provided on an upper surface of the piezoelectric layer, corresponding to the pressure chambers. The vibration plate is arranged such that the vibration plate covers 10 pressure chambers and two manifolds, and on a lower surface of the vibration plate, in an area overlapping with the two manifolds, a recess having a cross-sectional shape of a taper is formed. Due to the recess, a pressure wave which is propagated to the manifold can be attenuated assuredly.

13 Claims, 13 Drawing Sheets

LIQUID-DROPLET JETTING APPARATUS AND LIQUID TRANSPORTING APPARATUS

CROSS REFERENCE TO RELATED APPLICATION

The present application claims priority from Japanese Patent Application No. 2005-153904, filed on May 26, 2005, the disclosure of which is incorporated herein by reference in its entirely

BACKGROUND OF THE INVENTION

1. Field of the Invention

The present invention relates to a liquid-droplet jetting apparatus which jets a liquid from a nozzle, and a liquid transporting apparatus which transports a liquid.

2. Description of the Related Art

Among ink-jet heads, there is an ink-jet head in which by deforming a vibration plate by an actuator, pressure is applied to a pressure chamber which communicates with the nozzle, and ink is allowed to be jetted from the nozzle. In such ink-jet head, a pressure wave which is generated in the pressure chamber when the pressure is applied to the pressure chamber by the actuator is propagated via a manifold up to other pressure chamber communicating with that pressure chamber. Due to the propagation of the pressure wave, a volume of liquid droplets and a speed of liquid droplets are varied, and there is a possibility that a print quality is declined. For suppressing such propagation of the pressure wave, it is preferable to attenuate promptly the pressure wave in the manifold. However, for attenuating the pressure wave in the manifold, if a volume of the manifold is increased, there is an increase in a size of the entire apparatus, and if a specialized damper is provided in the manifold, the number of components is increased.

In view of this, an ink-jet head which can facilitate attenuation of a pressure fluctuation (change) in the manifold without providing the specialized damper is proposed. For example, in an ink-jet head disclosed in U.S. Pat. No. 5,943,079 (FIG. 3) (corresponds to Japanese Patent Application Laid-open Publication No. 9-141856 (FIG. 1)), a vibration plate of a uniform thickness is extended from area facing the pressure chamber up to an area facing the manifold, and a damper chamber is formed in the area of the vibration plate facing the manifold, on a side opposite to the manifold. Accordingly, the vibration plate can be deformed in an area facing the damper chamber. Therefore, by attenuating the pressure wave in the manifold by the deformation of the vibration plate, propagation of the pressure wave to the other pressure chamber via the manifold can be prevented to some extent.

SUMMARY OF THE INVENTION

However, in an ink-jet head in the U.S. Pat. No. 5,943,079, the vibration plate being thick, the vibration plate is not deformed sufficiently, and there is a possibility that the pressure wave cannot be attenuated assuredly in the manifold. For causing the vibration plate to be deformed sufficiently, reducing a stiffness of the vibration plate by making the entire vibration plate thin can be considered. However, when the vibration plate is made thin, a problem of strength of the vibration plate arises.

An object of the present invention is to provide a liquid-droplet jetting apparatus and a liquid transporting apparatus which can attenuate assuredly the pressure wave in the manifold, without increasing the number of components.

According to a first aspect of the present invention, there is provided a liquid-droplet jetting apparatus which jets a liquid in the form of liquid droplets, including:

a channel unit which includes a plurality of nozzles, a plurality of pressure chambers arranged along a plane, and which communicates with the nozzles respectively, and a common liquid chamber which communicates with the pressure chambers; and a piezoelectric actuator which changes selectively a volume of the pressure chambers to apply a pressure to the liquid in the pressure chambers;

the piezoelectric actuator including:

a plate arranged on a surface of the channel unit such that the plate covers the pressure chambers, a piezoelectric layer arranged on a surface of the plate at an area facing the pressure chambers, the surface being on a side opposite to the pressure chambers, a plurality of individual electrodes arranged on one surface of the piezoelectric layer, at areas each of which faces one of the pressure chambers, and a common electrode arranged on other surface of the piezoelectric layer;

wherein the plate is extended from an area facing the pressure chambers up to an area facing the common liquid chamber; and a recess is formed in a portion of the plate facing the common liquid chamber.

According to the first aspect of the present invention, the pressure chamber and the common electrode are adjacent, and the plate such as the vibration plate is extended from the area facing the pressure chamber up to the area facing the common liquid chamber. Furthermore, the recess is formed in the portion of the plate facing the common liquid chamber, and the thickness of the plate in this area is reduced. Therefore, in the portion of the recess, the plate is susceptible to deformation. Therefore, the portion of the plate in which the recess is formed functions as a damper, and the pressure wave in the common liquid chamber can be attenuated assuredly by the deformation of the plate. Moreover, the damper can be formed easily by only forming the recess in the plate. Therefore, there is no need to provide a damper member exclusively for forming the damper in the common liquid chamber, and the number of components can be reduced. Thus, it is possible to reduce a size and cost of the entire liquid-droplet jetting apparatus.

In the liquid-droplet jetting apparatus of the present invention, the common liquid chamber and the pressure chambers may be arranged adjacently without overlapping, when viewed from a direction orthogonal to the plane. In this case, the pressure chamber and the common liquid chamber are not required to be arranged in a stacked form, and can be arranged in the same plate. Therefore, the channel unit can be made thin.

In the liquid-droplet jetting apparatus of the present invention, the recess may be formed on a surface of the plate, on a side of the common liquid chamber. Accordingly, a surface of the plate on the side opposite to the common liquid chamber becomes a flat surface. Therefore, it is easy to form an electrode and a wiring pattern on the surface of the plate. Moreover, in a case of forming the piezoelectric layer on the surface of the plate on the side opposite to the common liquid chamber, the piezoelectric layer can be easily formed to be flat.

In the liquid-droplet jetting apparatus of the present invention, a cross-sectional shape of the recess may be a tapered toward a side opposite to the common liquid chamber. Accordingly, an angle of a corner portion of the recess is greater than 90°. Therefore, it is possible to prevent an air bubble from staying in the corner portion of the recess. Accordingly, a change in jetting characteristics of the liquid droplets due to staying of the air bubble in the corner portion is prevented.

In the liquid-droplet jetting apparatus of the present invention, the recess may be extended from the area facing the common electrode up to an area partially facing each of the pressure chambers, and a throttle channel, in which a channel area between the common liquid chamber and each of the pressure chambers becomes partially narrow, may be formed between the recess and the one surface of the channel unit. The channel area of the throttle channel has a substantial effect on the propagation of the pressure wave in the pressure chamber, and consequently has a substantial effect on an amount of liquid droplets jetted from the nozzle. Therefore, the throttle channel is required to be formed with precision. Here, in the present invention, the throttle channel being formed between a part of the recess extended up to the area facing the pressure chamber, and one of the surfaces of the channel unit, by forming a recess in a plate such as the vibration plate, the damper and the throttle channel can be formed simultaneously. Therefore, by forming the recess with precision, in the plate, both the damper and the throttle channel can be formed simultaneously with precision. Accordingly, it is possible to simplify a manufacturing process as compared to a case in which the throttle channel is formed separately from the recess, and a yield is improved.

In the liquid-droplet jetting apparatus of the present invention, a partition wall which partitions the common liquid chamber and each of the pressure chambers, may be formed between the common liquid chamber and each of the pressure chambers. The throttle channel may be formed between the partition wall and the recess formed in the plate, and a surface of the partition wall on a side of each of the pressure chambers may be formed to be inclined toward each of the pressure chambers in a direction away from the plate. Accordingly, an angle between a bottom surface of the pressure chamber and a surface of the partition wall on a side of the pressure chamber becomes greater than 90°. Therefore, it is possible to prevent the air bubble from staying in the corner portion between the bottom surface of the pressure chamber and the surface of the partition wall on the side of the pressure chamber. Accordingly, it is possible to prevent the changing of jetting characteristics of liquid droplets due to the staying of the air bubble in the corner portion.

In the liquid-droplet jetting apparatus of the present invention, the recess may include a plurality of communicating recesses each of which is formed to be extended from the area facing the common liquid chamber up to the area facing one of the pressure chambers, and each of which forms the throttle channel between one of the communicating recess and the surface of the channel unit. The plate may be joined to the one surface of the channel unit at an area between the communicating recesses. Accordingly, in the area between the communicating recesses, the plate such as the vibration plate is joined to the channel unit. Therefore, a fluctuation (change) in the channel area of the throttle channel in the communicating recess is suppressed.

In the liquid-droplet jetting apparatus of the present invention, two communicating recesses, may includ in the communicating recesses and corresponding to each of the pressure chambers, are provided to the plate. Each of the pressure chambers may include two liquid inflow areas which communicate separately with the two communicating recesses respectively, and the partition wall may be formed between the two liquid in flow areas. When the partition wall does not exist between the two liquid inflow areas, a flow of the liquid in an area between the two liquid inflow areas tends to be stagnated, and there is a possibility of the air bubble staying in this portion. However, since the partition wall exists between the two liquid inflow areas, it is possible to prevent the air bubble from staying between the two liquid inflow areas. Therefore, it is possible to prevent the changing of jetting characteristics of the liquid droplets due to the staying of the bubble between the two liquid inflow areas.

In the liquid-droplet jetting apparatus of the present invention, the recess may be formed as a plurality of individual recesses lined up in one predetermined direction, in a portion of the plate facing the common liquid chamber, and furthermore, the individual recesses are formed alternately on a surface of the plate on the side of the common liquid chamber, and on the other surface of the plate on a side opposite to the common liquid chamber. Accordingly, in the area facing the common liquid chamber, a stiffness of the plate can be reduced effectively due to the recesses formed alternately on both surfaces of the plate such as the vibration plate.

In the liquid-droplet jetting apparatus of the present invention, the piezoelectric layer may be formed on the plate at an area excluding the portion facing the common liquid chamber. Accordingly, the plate is more susceptible to deformation as compared to a case in which the piezoelectric layer is formed in a portion facing the common liquid chamber of the plate such as the vibration plate. Therefore, an attenuation effect of the pressure wave due to the deformation of the plate is improved.

In the liquid-droplet jetting apparatus of the present invention, the piezoelectric layer may be formed continuously from a portion of the plate facing the pressure chambers, up to the portion of the plate facing the common liquid chamber and one of a groove and a hole may be formed in a portion of the piezoelectric layer facing the common liquid chamber. The formation of the piezoelectric layer in a structure in which the piezoelectric layer is formed from the portion of the plate such as the vibration plate, facing the pressure chamber up to the portion facing the common liquid chamber is easier than the formation of the piezoelectric layer in a structure in which the piezoelectric layer is formed in the portion of the plate facing the pressure chamber and not formed in the portion of the plate facing the common liquid chamber. However, since piezoelectric layer is formed in the portion facing the common liquid chamber, the deformation of the plate is hindered to some extent, and the effect of attenuation of the pressure wave in the common liquid chamber is declined. However, in the present invention, a groove or a hole such as a through hole is formed in the portion of the piezoelectric layer facing the common liquid chamber. Therefore, the stiffness of the piezoelectric layer in the portion facing the common liquid chamber is reduced, and the deformation of the plate is hardly hindered by the piezoelectric layer. Therefore, even with the structure in which the piezoelectric layer is formed in the portion of the plate facing the common liquid chamber, the pressure wave can be attenuated sufficiently by the deformation of the plate.

According to a second aspect of the present invention, there is provided a liquid transporting apparatus which transports a liquid, including: a channel unit which includes a plurality of pressure chambers arranged along a plane, a common liquid chamber which communicates with the pressure chambers, and a piezoelectric actuator which changes selectively a volume of the pressure chambers to apply a pressure to the liquid in the pressure chambers;

the piezoelectric actuator including:

a plate arranged on one surface of the channel unit such that the plate covers the pressure chambers, a piezoelectric layer arranged on a surface of the plate at an area facing the pressure chambers, the surface being on a side opposite to the pressure chambers, a plurality of individual electrodes arranged on one surface of the piezoelectric layer at areas each of which faces one of the pressure chambers, and a common electrode arranged on other surface of the piezoelectric layer;

wherein the plate is extended from an area facing the pressure chambers, up to an area facing the common liquid chamber; and a recess is formed in a portion of the plate facing the common liquid chamber. The pressure chambers and the common liquid chamber may be arranged adjacently without overlapping, when viewed from a direction orthogonal to the plane.

According to the second aspect of the present invention, the pressure chamber and the common liquid chamber may be adjacent, and the plate such as the vibration plate is extended from the area facing the pressure chamber up to the area facing the common liquid chamber. Furthermore, the recess is formed in the area of the plate facing the common liquid chamber, and in this area the thickness of the plate is reduced. Therefore, by the deformation of the plate, the pressure wave can be attenuated assuredly in the common liquid chamber.

DETAILED DESCRIPTION OF THE PREFERRED EMBODIMENTS

First Embodiment

A first embodiment of the present invention will be described while referring to the accompanying diagrams. The first embodiment is an example in which the present invention is applied to an ink-jet head as a liquid-droplet jetting apparatus which jets ink from a nozzle, and as a liquid transporting apparatus.

Figure 1:
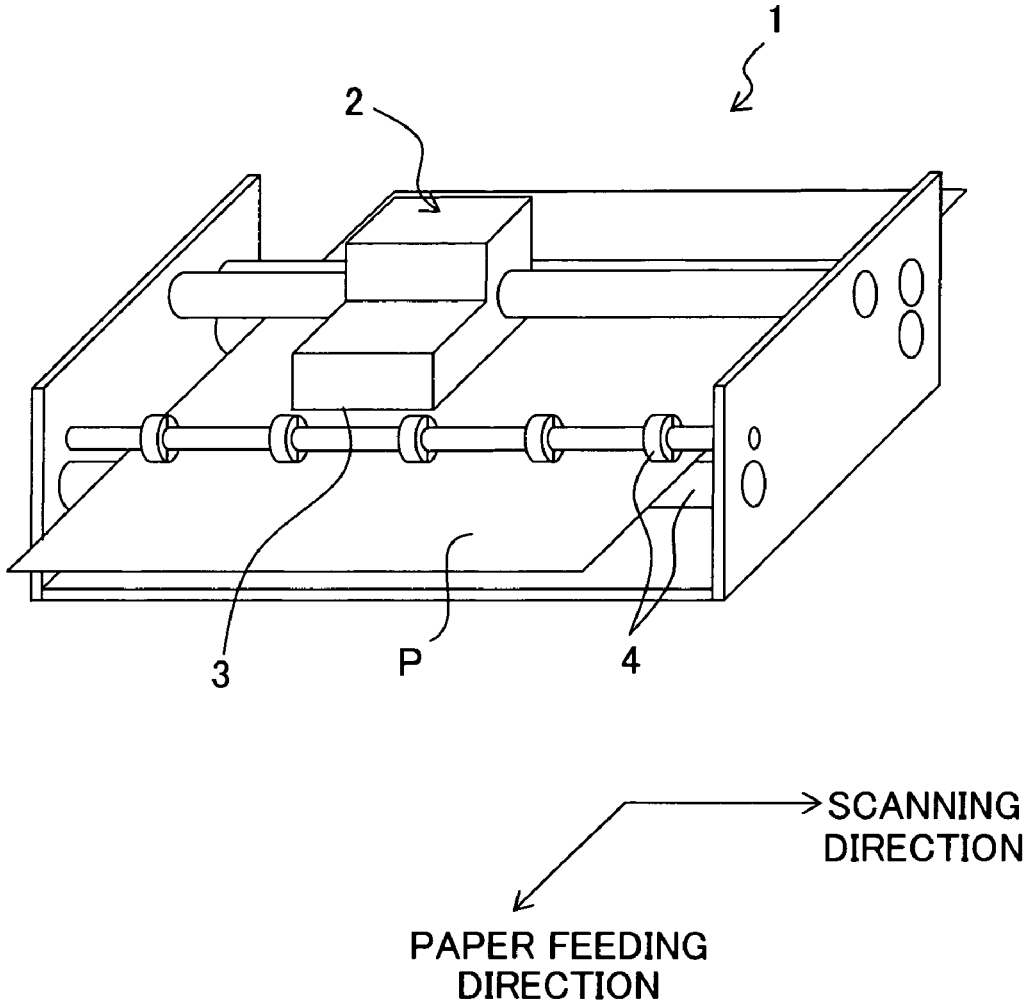
FIG. 1 is a schematic structural diagram of an ink-jet printer according to a first embodiment of the present invention.

Firstly, an ink-jet printer 1 which includes an ink-jet head 3 will be described briefly with reference to FIG. 1. As shown in FIG. 1, the ink-jet printer 1 includes a carriage 2 which is movable in a left and right direction (scanning direction) in FIG. 1, the ink-jet head 3 of a serial type which is provided on the carriage 2 and discharges ink onto a recording paper P, and transporting rollers 4 which carry the recording paper Pin a forward direction (paper feeding direction) in FIG. 1. The ink-jet head 3 moves integrally with the carriage 2 in the scanning direction, and discharges ink on to the recording paper P from a nozzle 15 (refer to FIG. 2 to FIG. 5). The recording paper P with an image and/or characters recorded thereon is discharged in the paper feeding direction by the transporting rollers 4.

Figure 2:
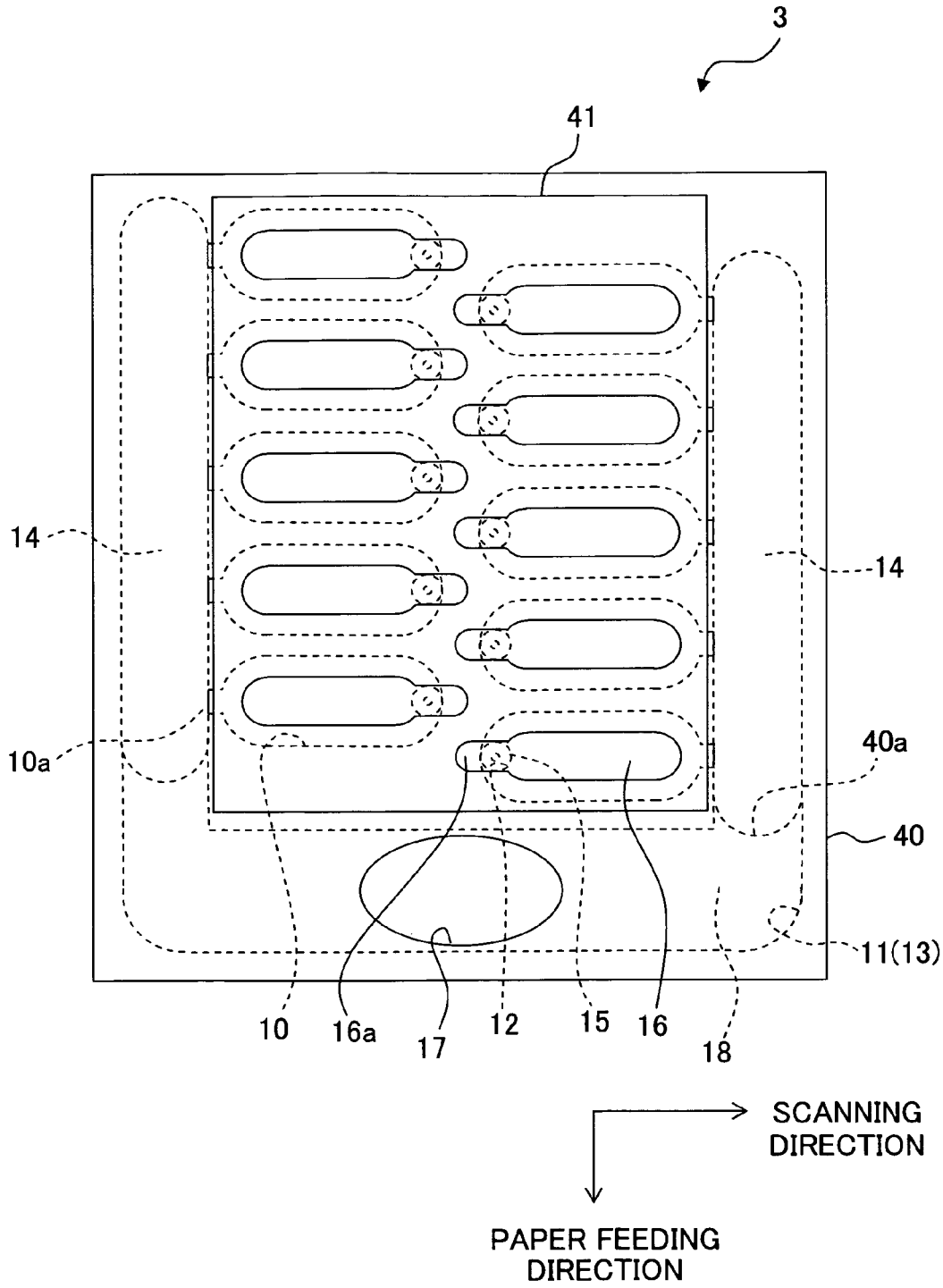
FIG. 2 is a plan view of an ink-jet head in FIG. 1.
Figure 3:
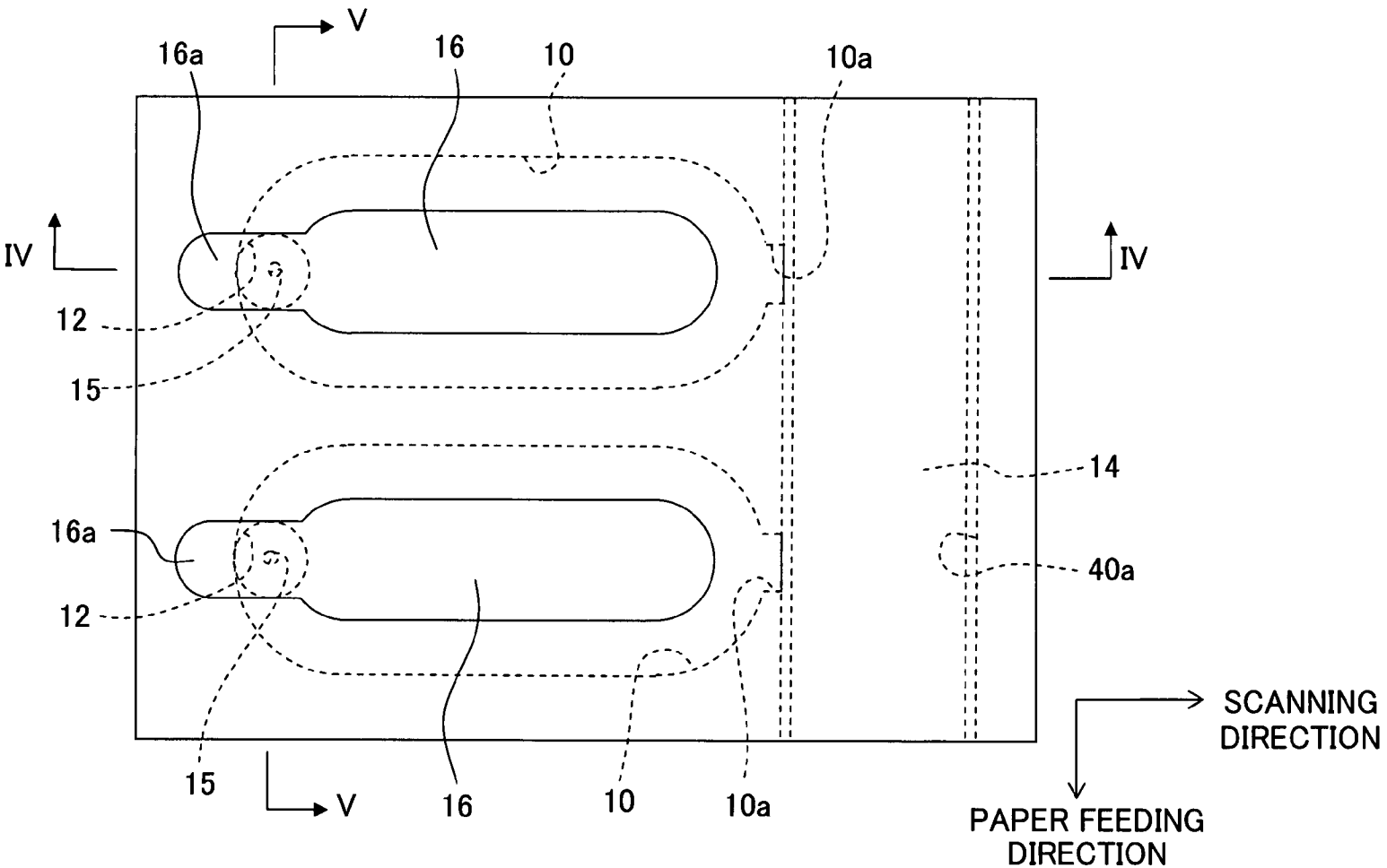
FIG. 3 is an enlarged view of FIG. 2.
Figure 4:
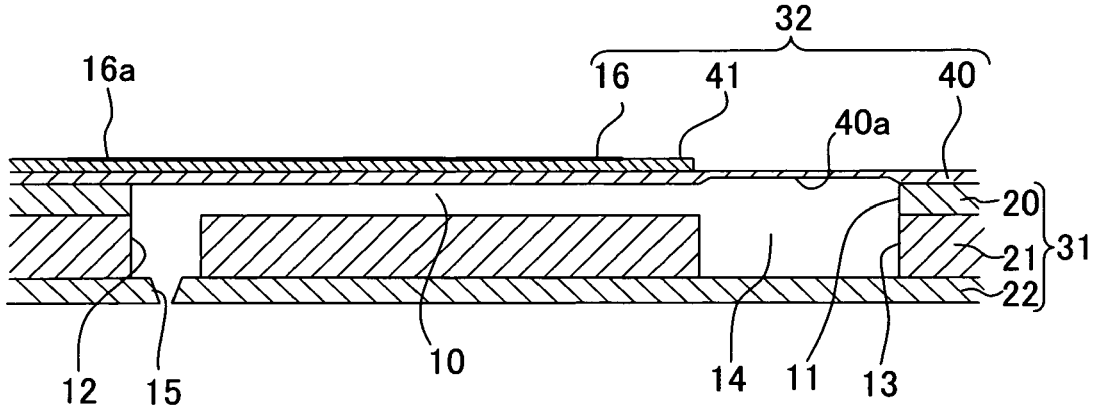
FIG. 4 is a cross-sectional view taken along a line IV-IV shown in FIG. 3.
Figure 5:
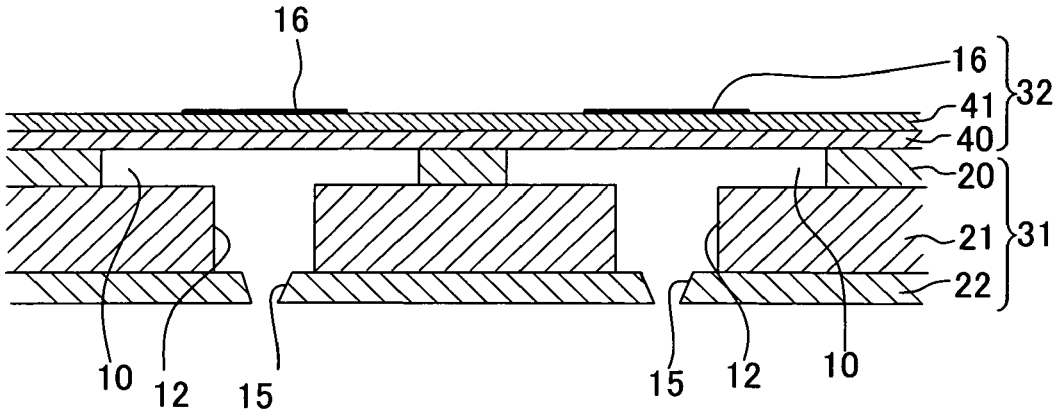
FIG. 5 is a cross-sectional view taken along a line V-V shown in FIG. 3.

Next, the ink-jet head 3 will be described in detail with reference to FIG. 2 to FIG. 5. FIG. 2 is a plan view of the ink-jet head 3 in FIG. 1, FIG. 3 is a partially enlarged view of FIG. 2, FIG. 4 is a cross-sectional view taken along a line IV-IV shown in FIG. 3, and FIG. 5 is a cross-sectional view taken along a line V-V shown in FIG. 3. As it is shown in FIG. 2 to FIG. 5, the ink-jet head 3 includes 10 pressure chambers 10, two manifolds 14 (common liquid chambers) which communicate with 10 pressure chambers 10, a channel unit 31 in which 10 individual ink channels are formed, and a piezoelectric actuator 32 which is arranged on an upper surface of the channel unit 31.

Firstly, the channel unit 31 will be described below. As shown in FIG. 4 and FIG. 5, the channel unit 31 includes a cavity plate 20, a manifold plate 21, and a nozzle plate 22, and these three plates are joined in stacked layers. Among these three plates, the cavity plate 20 and the manifold plate 21 are stainless steel plates having a substantially rectangular shape. Moreover, the nozzle plate 22 is formed of a high-molecular synthetic resin material such as polyimide, and is joined to a lower surface of the manifold plate 21. The nozzle plate 22 may also be formed of a metallic material as the two plates 20 and 21.

In the cavity plate 20, the 10 pressure chambers 10 arranged along a flat surface are formed in two rows of five pressure chambers 10 each, as shown in FIG. 2 to FIG. 5. Each pressure chamber 10 is formed to be substantially elliptical in a plan view, and is arranged such that a longitudinal direction of the elliptical shape is the scanning direction. Moreover, in the cavity plate 20, a through hole 11 having a substantially U-shape is formed in an area on an outer side of the pressure chamber 10, in the left and right direction in FIG. 2. The through hole 11 is formed to be adjacent to five pressure chambers 10 in each row, and is formed to extend in the paper feeding direction (vertical direction in FIG. 2) across these five pressure chambers 10. Moreover, the through hole 11 is formed to be extended in the scanning direction (left and right direction in FIG. 2) at a lower end portion in FIG. 2. Here, the pressure chamber 10 and the through hole 11 communicate mutually via a communicating portion 10*a* which is a through hole formed in an edge portion of the pressure chamber on a side adjacent to the through hole 11. A width (length in vertical direction in FIG. 2) of the communicating portion 10*a* is less than a width of the pressure chamber 10.

As shown in FIG. 2 to FIG. 5, a communicating hole 12 formed in a circular shape which communicates with the pressure chamber 10 is formed in the manifold plate 21 at a position overlapping with an end portion on a side opposite to a side adjacent to the manifold 14, in a longitudinal direction of the pressure chamber 10 in a plan view. Furthermore, a through hole 13 which forms a lower portion of the two manifolds 14, and a lower portion of an ink supplying channel 18 is formed in an area of the manifold plate 21, overlapping with the through hole 11. Moreover, the nozzle 15 which communicates with the communicating hole 12 is formed in the nozzle plate 22.

Further, the through holes 11 and 13 are closed from top and bottom by the nozzle plate 22 and a vibration plate 40 which will be described later. The two manifolds 14 and the ink supply channel 18 which communicates with the two manifolds 14 and which is used for supplying the ink to the two manifolds 14 are formed between the nozzle plate 20 and the vibration plate 40. In this case, in the cavity plate 21, the pressure chamber 10 and the through hole 11 are arranged adjacently such that the pressure chamber 10 and the through hole 11 do not overlap in a plan view, and the through hole 11 and the through hole 13 are arranged at positions overlapping mutually. In other words, the manifold 14 and the pressure chamber 10 are arranged adjacently not overlapping in the plan view. Therefore, as in a case in which a part of the pressure chamber 10 and the manifold 14 are arranged to be overlapping, there is no need to provide a member for partitioning the pressure chamber 10 and the manifold 14 in an area of overlapping, and the number of components can be reduced. Moreover, ink is supplied to the ink supply channel 18 from an ink tank which is not shown in the diagram, via an ink supply port 17.

Further, as shown in FIG. 4, the manifold 14 communicates with the pressure chamber 10 via the communicating hole 10*a*, and the pressure chamber 10 communicates with the nozzle 15 via the communicating hole 12. Thus, in the channel unit 31, 10 individual ink channels from the manifold 14 to the pressure chamber 10, and from the pressure chamber 10 to the nozzle 15 are formed.

Next, the piezoelectric actuator 32 will be described below. As shown in FIG. 4 and FIG. 5, the piezoelectric actuator 32 includes the vibration plate 40, a piezoelectric layer 41, and 10 individual electrodes 16. The vibration plate 40 which is electroconductive is arranged continuously from an area on an upper surface of the channel unit 31, facing the 10 pressure chambers, up to an area facing the two manifolds 14 adjacent to the 10 pressure chambers 10, and the ink supply channel 18. The piezoelectric layer 41 is not formed in an area overlapping with the manifold 14 and the ink supply channel 18, on a surface of the vibration plate 40, on a side opposite to the pressure chamber 10, but is formed continuously spreading over the 10 pressure chambers 10. The 10 individual electrodes 16 are formed corresponding to 10 pressure chambers 10, on an upper surface of the piezoelectric layer 41.

The vibration plate 40 is a plate having a thickness of approximately 20 μm to 30 μm, and is made of a metallic material such as an iron alloy like stainless steel, a nickel alloy, an aluminum alloy, and a titanium alloy. As shown in FIG. 4 and FIG. 5, the vibration plate 40 is joined to the cavity plate 20, covering the 10 pressure chambers 10 and the two manifolds 14. The vibration plate 40 also serves as a common electrode which is an electrode facing the 10 individual electrodes 16, and which generates an electric field in the piezoelectric layer 41 between the individual electrode 16 and the vibration plate 40. The vibration plate 40 is always kept at a ground electric potential.

Moreover, as shown in FIG. 3 and FIG. 4, a recess 40*a* is formed in an area on a lower surface (surface on a side of the manifold 14) of the vibration plate 40, facing the manifold 14. The thickness of the vibration plate in the area where the recess 40*a* is formed is less (thin) (about 10 μm for example). A surface of the recess 40*a* is a flat surface, and a cross-sectional shape of the recess 40*a* is tapered toward the upper surface of the vibration plate 40 (upper side) (the more it parts from the manifold 14). Therefore, an angle of a corner portion of the recess 40*a* is greater than 90°, and an air bubble can be prevented from staying in the corner portion of the recess 40*a*. Accordingly, changing of jetting characteristics of liquid droplets due to the staying of the air bubble in the corner portion is prevented. Here, the angle of the corner portion of the recess 40*a* can be formed to be a desirable angle by adjusting processing conditions such as a speed of etching. The recess 40*a* being formed on the lower surface of the vibration plate 40, the upper surface of the vibration plate 40 is a flat surface.

The piezoelectric layer 41 which is composed of mainly lead zirconate titanate (PZT) which is a solid solution of lead titanate and lead zirconate, and is a ferroelectric substance is formed on the surface of the vibration plate 40 as shown in FIG. 4 and FIG. 5. The piezoelectric layer 41 is formed spreading over the area of the vibration plate 40, facing the 10 pressure chambers 10. However, the piezoelectric layer 41 is not formed in the area of the vibration plate 40, facing the manifold 14 and the ink supply channel 18. Here, the piezoelectric layer is formed by an aerosol deposition method (AD method), in which very fine particles of a piezoelectric material are deposited by causing to collide at a high speed on the surface of the vibration plate 40. Apart from this, the piezoelectric layer 41 can also be formed by using a sol-gel method, a sputtering method, a hydrothermal synthesis method, or a CVD (chemical vapor deposition) method. Furthermore, the piezoelectric layer 41 can also be formed by adhering on the surface of the vibration plate 40 a piezoelectric sheet which is obtained by baking a green sheet of PZT.

On the upper surface of the piezoelectric layer 40, 10 individual electrodes 16 having an elliptical shape slightly smaller than the shape of the pressure chamber 10 in a plan view, are formed as shown in FIG. 2 to FIG. 5. Each of these 10 individual electrodes 16 is formed to overlap with a central portion of the corresponding pressure chamber 10 in a plan view. The individual electrode 16 is made of an electroconductive material such as gold, copper, silver, palladium, platinum, and titanium. Furthermore, on the upper surface of the piezoelectric layer 41, 10 contact portions 16*a* are formed in a longitudinal direction of the pressure chamber 10 of 10 individual electrodes 16 (refer to FIG. 2). The contact portion 16*a* is extended from an end portion on a side opposite to an end portion which is adjacent to the manifold 14, up to a central portion of the piezoelectric layer 41 in the scanning direction. The individual electrode 16 and the contact portion 16*a* can be formed by a method such as a screen printing, the sputtering method, and a vapor deposition method. Moreover, the contact portion 16*a* is connected to a driver IC which is not shown in the diagram, via a flexible printed circuit (FPC) which is not shown in the diagram. Here, the contact portions 16*a* being arranged to be concentrated in the portion of the vibration plate 41, not facing the pressure chamber 10 and the manifold 14, while joining the contact portion 16*a* and the FPC, the FPC can be pressed hard against the contact portion 16*a*, and the contact portion 16*a* and the FPC can be joined firmly.

Next, an action of the piezoelectric actuator 32 will be described below. When a drive voltage is supplied selectively from the driver IC to the individual electrode 16, via the FPC, an electric field is generated in a vertical direction in the piezoelectric layer 41 in a portion sandwiched between the individual electrode 16 to which the drive voltage is supplied, and the vibration plate 40 which also serves as the common electrode and which is kept at the ground electric potential. As the electric field is generated in the piezoelectric layer 41, the piezoelectric layer 41 in the portion sandwiched between the individual electrode 16 to which the drive voltage is applied, and the vibration plate 40 is contracted in a horizontal direction which is perpendicular to a direction of thickness, which is a direction in which the piezoelectric layer 41 is polarized. Further, with the contraction of the piezoelectric layer 41, the vibration plate 40 and the piezoelectric layer 41 in the area opposite to the pressure chamber are deformed to form a projection toward the pressure chamber 10. Due to the projection formed, a volume of the pressure chamber is decreased, and a pressure on the ink is increased. Therefore, ink is jetted from the nozzle 15 which communicates with the pressure chamber 10.

When the pressure in the pressure chamber 10 is changed in such manner, a pressure wave is generated in the pressure chamber 10. At this time, the communicating portion 10*a* being narrower than a width of the pressure chamber 10, a propagation of the pressure wave to the manifold 14 is suppressed by the communicating portion 10*a*. However, the pressure wave, to some extent, is still propagated to the manifold 14.

Here, as shown in FIG. 2 and FIG. 4, the pressure chamber 10 and the manifold 14 are arranged adjacently, and the vibration plate 40 is extended from the area facing the pressure chamber 10 up to the area facing the manifold 14. Furthermore, the recess 40*a* is formed in the area of the vibration plate 40, facing the manifold 14, and the thickness of the vibration plate 40 is reduced. Therefore, the vibration plate 40 can be deformed easily in the area of reduced thickness. For this reason, the portion of the vibration plate 40 in which the recess 40*a* is formed, functions as a damper, and the pressure wave propagated from the pressure chamber 10 to the manifold 14 can be attenuated assuredly by the deformation of the vibration plate 40. Therefore, the pressure wave propagated to the manifold 14 is prevented from propagating to other pressure chamber 10.

Moreover, since the damper can be formed easily by only forming the recess 40*a* in the vibration plate 40, a damper member exclusively for providing the damper is not required, and the number of components is not increased. Therefore, a manufacturing cost and a size of the ink-jet head 3 can be reduced.

Furthermore, the piezoelectric layer 41 being formed in the portion of the vibration plate 40, facing the manifold 14, the deformation of the vibration plate 40 is not hindered by the piezoelectric layer 41 in the portion in which the piezoelectric layer 41 is formed, and the pressure wave can be attenuated assuredly in the manifold 14.

Next, modified embodiments in which various modifications are made in the first embodiment will be described below. Same reference numerals are used for components which have the same structure as in the first embodiment, and the description of these components is omitted.

First Modified Embodiment

Figure 6:
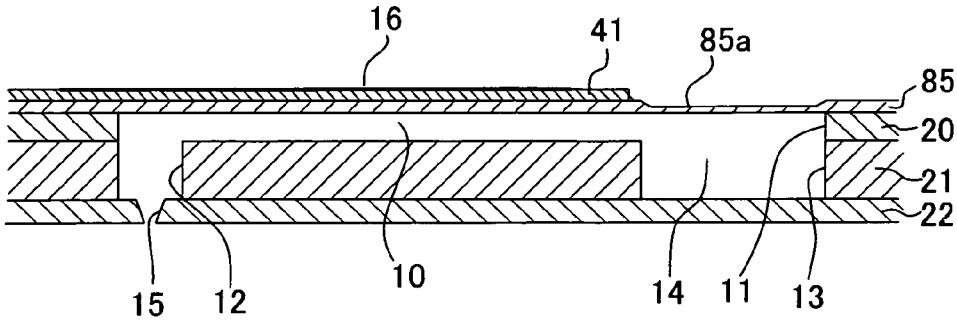
FIG. 6 is a cross-sectional view corresponding to FIG. 4 of a first modified embodiment.

As shown in FIG. 6, a recess 85*a* may be formed on an upper surface of a vibration plate 85. Even in this case, the thickness of the vibration plate 85 in an area where the recess 85*a* is formed is reduced, and the vibration plate 85 is more susceptible to deformation (deformable) in the area of formation of the recess 85*a*. Therefore, the pressure wave can be attenuated in the manifold 14 by the deformation of the vibration plate 85.

Second Embodiment

Figure 7:
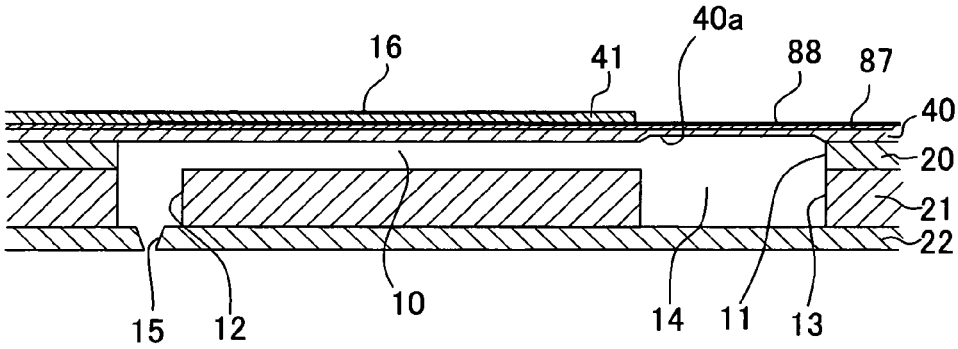
FIG. 7 is a cross-sectional view corresponding to FIG. 4 of a second modified embodiment.

The common electrode may be provided separately apart from the vibration plate 40. For example, as shown in FIG. 7, an insulating material layer 87 made of an insulating material may be formed on the upper surface of the vibration plate 40, and a common electrode 88 may be formed on an upper surface of the insulating material layer 87. In this case, the recess 40*a* of the vibration plate 40 being formed on a lower side, and the upper surface of the vibration plate 40 being a flat surface, the insulating material layer 87 and the common electrode 88 can be formed easily on the upper surface of the vibration plate 40.

Third Modified Embodiment

Figure 8:
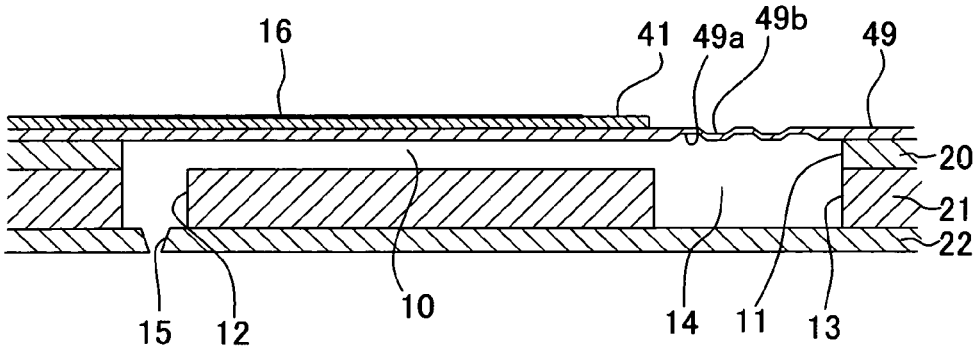
FIG. 8 is a cross-sectional view corresponding to FIG. 4 of a third modified embodiment.

As shown in FIG. 8, a plurality of recesses 49*a* which is formed in a lower surface of a vibration plate 49, in an area of the vibration plate 49, facing the two manifolds 14, and extended in the paper feeding direction (a direction perpendicular to a surface of the paper in FIG. 8), and a plurality of recesses 49*b* which is formed on an upper surface of the vibration plate 49, and extended in the paper feeding direction, may be arranged alternately, to be lined up on the longitudinal direction of the pressure chamber 10. In this case, by forming the recesses (individual recesses) 49*a* and 49*b*, the stiffness of the vibration plate 49 in which the recesses are formed is reduced effectively, and the vibration plate 49 is made to be more susceptible to deformation.

Fourth Modified Embodiment

Figure 9:
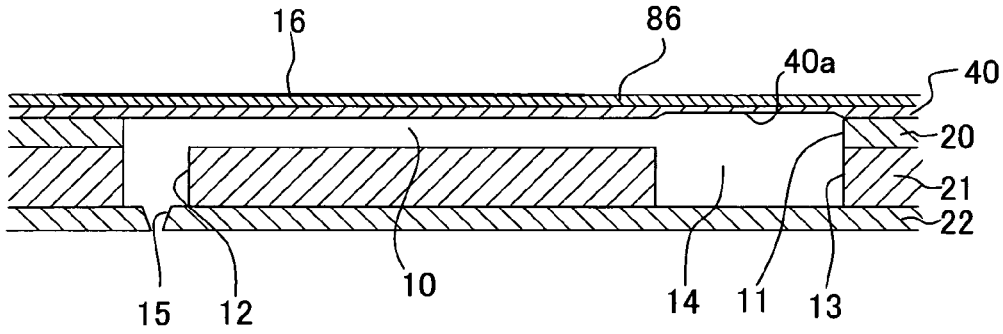
FIG. 9 is a cross-sectional view corresponding to FIG. 4 of a fourth modified embodiment.

As shown in FIG. 9, a piezoelectric layer 86 may be formed over an entire area of the upper surface of the vibration plate 40, which includes the portion facing the pressure chamber 10 and the portion facing the manifold 14. In this case, the piezoelectric layer 86 being on the entire area of the upper surface of the vibration plate 40, and the upper surface of the vibration plate 40 being a flat surface without any recess and projection, even in a case in which the piezoelectric layer 86 is not formed in the portion facing the manifold 14, the piezoelectric layer 86 can be formed easily by the AD method described earlier. In this case, the piezoelectric layer 86 being formed even in a portion overlapping with the manifold 14 in a plan view, the deformation of the vibration plate 40 is hindered to some extent. However, since the thickness of the vibration plate in the portion in which the recess 40*a* is formed is reduced, and the vibration plate 40 is more susceptible to deformation, even in this case, the pressure wave can be attenuated effectively in the manifold 14 by the deformation of the vibration plate 40.

Fifth Modified Embodiment

Figure 10:
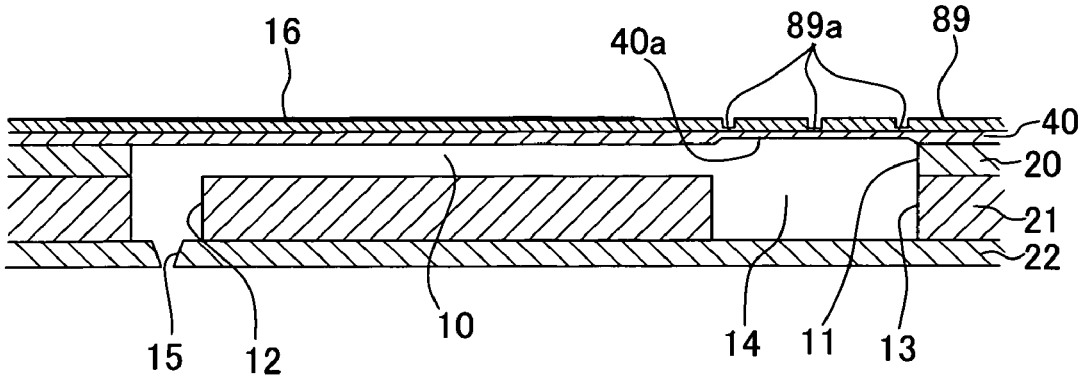
FIG. 10 is a cross-sectional view corresponding to FIG. 4 of a fifth modified embodiment.

Furthermore, as shown in FIG. 10, a plurality of grooves 89*a* extending in the paper feeding direction (direction perpendicular to the surface of the paper in FIG. 10) may be formed in an upper surface of an area of a piezoelectric layer 89, overlapping with the manifold 14. When the piezoelectric layer 89 is formed in the area facing the manifold 14, the deformation (vibration) of the vibration plate 40 is hindered to some extent by the piezoelectric layer 89. However, in this case, the grooves 89*a* being formed in the portion of the piezoelectric layer 89, facing the manifold 14, the stiffness of the area of the piezoelectric layer 89, in the portion facing the manifold 14 is decreased, and the deformation of the vibration plate 40 is hardly hindered by the piezoelectric layer 89. Instead of the grooves 89*a*, a plurality of through holes piercing through the piezoelectric layer 89 may be formed in the area of the piezoelectric layer 89, overlapping with the manifold 14. Moreover, the hole formed in the area of the piezoelectric layer 89, overlapping with the manifold 14, may be a hole which pierces through the piezoelectric layer 89, or a hole (recess) which does not pierce through the piezoelectric layer 89.

Second Embodiment

Next, a second embodiment will be described below by referring to FIG. 11 and FIG. 12. Same reference numerals are used for components having the same structure as in the first embodiment, and the description of such components is omitted.

Figure 11:
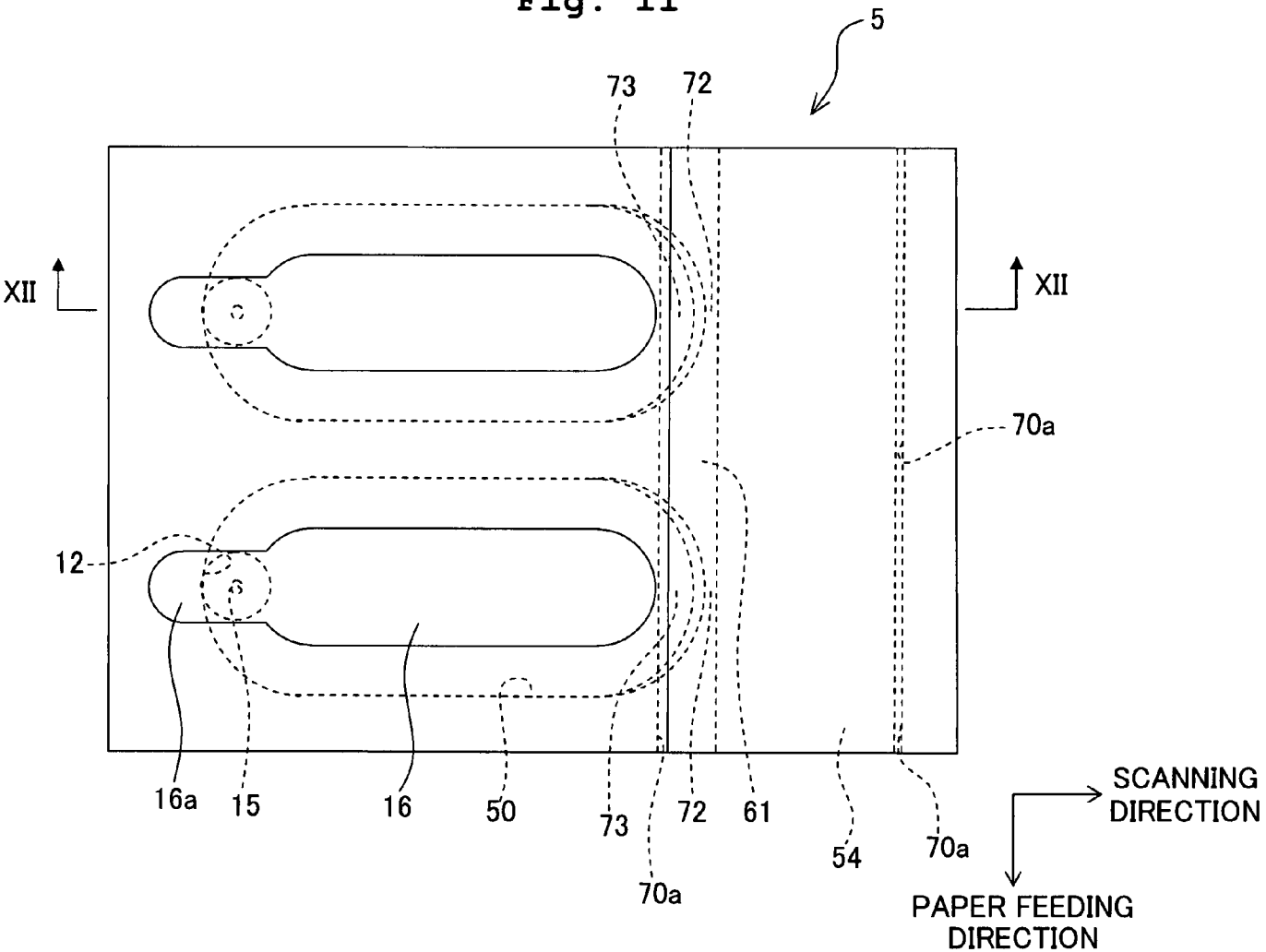
FIG. 11 is a plan view corresponding to FIG. 3 of a second embodiment.
Figure 12:
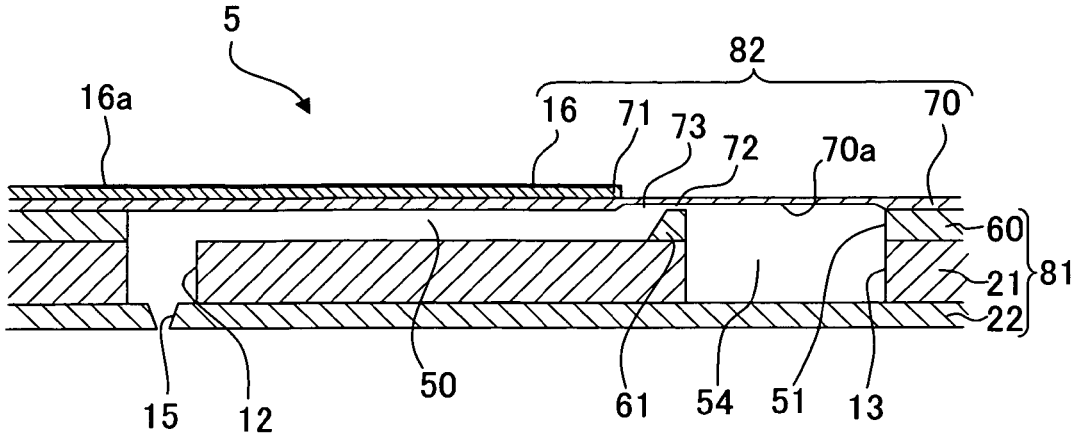
FIG. 12 is a cross-sectional view taken along a line XII-XII shown in FIG. 11.

FIG. 11 is a plan view corresponding to FIG. 3 of an ink-jet head 5 according to the second embodiment, and FIG. 12 is a cross-sectional view taken along a line XII-XII shown in FIG. 11. As shown in FIG. 11 and FIG. 12, the ink-jet head 5, similar to the ink-jet head 3 of the first embodiment (refer to FIG. 2), includes a channel unit 81 which has 10 pressure chambers 50, and two manifolds 54 communicating with these 10 pressure chambers 50, and in which 10 individual ink channels are formed, and a piezoelectric actuator 82 which is arranged on an upper surface of the channel unit 81.

As shown in FIG. 11 and FIG. 12, the channel unit 81 includes a cavity plate 60, the manifold plate 21, and the nozzle plate 22, and these three plates 60, 21, and 22 are joined in stacked layers. Among these three plates 60, 21, and 22, the two plates, in other words, the manifold plate 21 and the nozzle plate 22 are similar as in the first embodiment, and the description of these plates is omitted.

In the cavity plate 60, similarly as in the cavity plate 20 of the first embodiment, the 10 pressure chambers 50 arranged along the flat surface are formed in two rows of five pressure chambers 10 each. Each pressure chamber 50 is formed to be substantially elliptical in a plan view. Moreover, in the cavity plate 60, a though hole 51 having a shape substantially similar to the through hole 11 in the first embodiment is formed at a position of the manifold plate 21, overlapping with the through hole 13 in a plan view. The through hole 51 is extended in the paper feeding direction, over each row of five pressure chambers, and is extended in the scanning direction, at one end of the paper feeding direction. The pressure chamber 50 and the through hole 51 are arranged adjacently, and are partitioned mutually by a partition wall 61 which is formed between the pressure chamber 50 and the through hole 51. The partition wall 61 is formed to be inclined toward the pressure chamber 10 as a side surface on a side facing the pressure chamber 50 becomes closer to the manifold plate 21 (more the partition wall is separated apart from a vibration plate). In other words, this side surface is an inclined surface making an angle greater than 90° with a bottom surface of the pressure chamber 50 (upper surface of the manifold plate 21).

The through holes 13 and 51 are closed from the top and bottom by the nozzle plate 22 and a vibration plate 70 which will be described later, and the manifold 54 and the ink supply channel 18 (refer to FIG. 2) are formed in the channel unit 81. Here, the pressure chamber 50 and the through hole 51 being partitioned by the partition wall 61, the pressure chamber 50 and the manifold 54 are partitioned mutually by the partition wall 61.

Moreover, as shown in FIG. 11 and FIG. 12, an ink inflow port 73 is formed between a recess 70*a* of the vibration plate 70 which will be described later, and an end portion of a side in the longitudinal direction of the pressure chamber 50, adjacent to the manifold 54. Furthermore, a throttle channel 72 in which a channel area between the pressure chamber 50 and the manifold 54 has become partially small (narrow), is formed between the partition wall 61 and the recess 70*a* of the vibration plate 70. As shown in FIG. 12, the manifold 54 communicates with the pressure chamber 50 via the throttle channel 72 and the ink inflow port 73, and the pressure chamber 50 communicates with the nozzle 15 via the communicating hole 12. Accordingly, an individual ink channel from the manifold 54 up to the nozzle 15, via the pressure chamber 50 is formed.

The vibration plate 70, similar to the vibration plate 40 in a case of the first embodiment (refer to FIG. 2 to FIG. 5) is made of a metallic material such as an iron alloy like stainless steel, a nickel alloy, an aluminum alloy, and a titanium alloy, and has a thickness of approximately 20 μm to 30 μm. As shown in FIG. 11 and FIG. 12, the recess 70*a* is formed in a lower surface of the vibration plate 70. The recess 70*a* is extended from an area facing the manifold 54 up to an area in the longitudinal direction of the pressure chamber 50, facing an end portion on a side adjacent to the manifold 54. The thickness of the vibration plate 70 in a portion in which the recess 70*a* is formed is less (thin) (about 10 μm for example). A surface of the recess 70*a*, similar to the surface of the recess 40*a* in the first embodiment (refer to FIG. 2 to FIG. 4), is a flat surface, and a cross-sectional shape of the recess 70*a* is tapered toward the upper surface of the vibration plate 70.

Accordingly, as shown in FIG. 11 and FIG. 12, the ink supply port (ink inlet port) 73 is formed between a portion of the vibration plate 70 in which the recess 70*a* is formed, and the end portion in the longitudinal direction of the pressure chamber 50, on a side adjacent to the manifold 54. Furthermore, the throttle channel 72 is formed between the portion of the vibration plate 70 in which the recess 70*a* is formed, and an upper surface of the partition wall 61. Here, a channel height of the throttle channel 72 is equal to a depth of the recess 70*a*. Therefore, a channel area of the throttle channel 72 (cross-sectional area of the channel) between the pressure chamber 50 and the manifold 54 is sufficiently narrow (small) as compared to the ink supply port 73 and the communicating hole 12. Due to this throttle channel 72, the structure becomes such that the pressure wave generated in the pressure chamber 50 is hardly propagated to the manifold 54.

Incidentally, the channel area of the throttle channel 72 affects the propagation of the pressure wave in the pressure chamber 50, and consequently, have a substantial effect on ink-jetting characteristics such as a speed and a volume of ink droplets which are jetted from the nozzle 15. Therefore, the throttle channel 72 is required to be formed with precision. In the second embodiment, the throttle channel 72 being formed between a part of the recess 70*a* which is formed in the lower surface of the vibration plate 70, and the upper surface of the cavity plate 60, when the recess 70*a* is formed with precision in the vibration plate 70, the throttle channel 72 is also formed with precision. Therefore, a manufacturing process of the ink-jet head can be simplified as compared to a case in which the throttle channel 72 is formed separately apart from the recess 70*a*, and the yield is also improved.

Moreover, a side surface of the partition wall 61, on a side of the pressure chamber is an inclined surface making an angle greater than 90° with the bottom surface of the pressure chamber 50. Therefore, as compared to a case in which the side surface of the partition wall 61 is orthogonal to the bottom surface of the pressure chamber 50, an inflow of ink from the throttle channel 72 into the pressure chamber 50 is hardly stagnated, and ink is infused smoothly into the pressure chamber 50. Therefore, an air bubble in a corner portion which is formed by the bottom surface of the pressure chamber 50 and the side surface of the partition wall 61 can be prevented from staying in the corner portion, and changing of the jetting characteristics of ink due to the staying of the air bubble in the corner portion can be prevented.

Furthermore, in the second embodiment, the pressure chamber 50 and the manifold 54 are arranged adjacently. The vibration plate 70 is formed to be extending from the area facing the pressure chamber 50 up to the area facing the manifold 54, and the recess 70*a* is formed in the area of the vibration plate 70 facing the manifold 54. Therefore, similarly as in the case of the first embodiment, the pressure wave can be attenuated assuredly in the manifold 54, by the deformation of the vibration plate 70.

Next, modified embodiments in which various modifications are made in the second embodiment will be described below. Same reference numerals are used for components having the same structure in the second embodiment, and the description of these components is omitted.

Sixth Modified Embodiment

Figure 13:
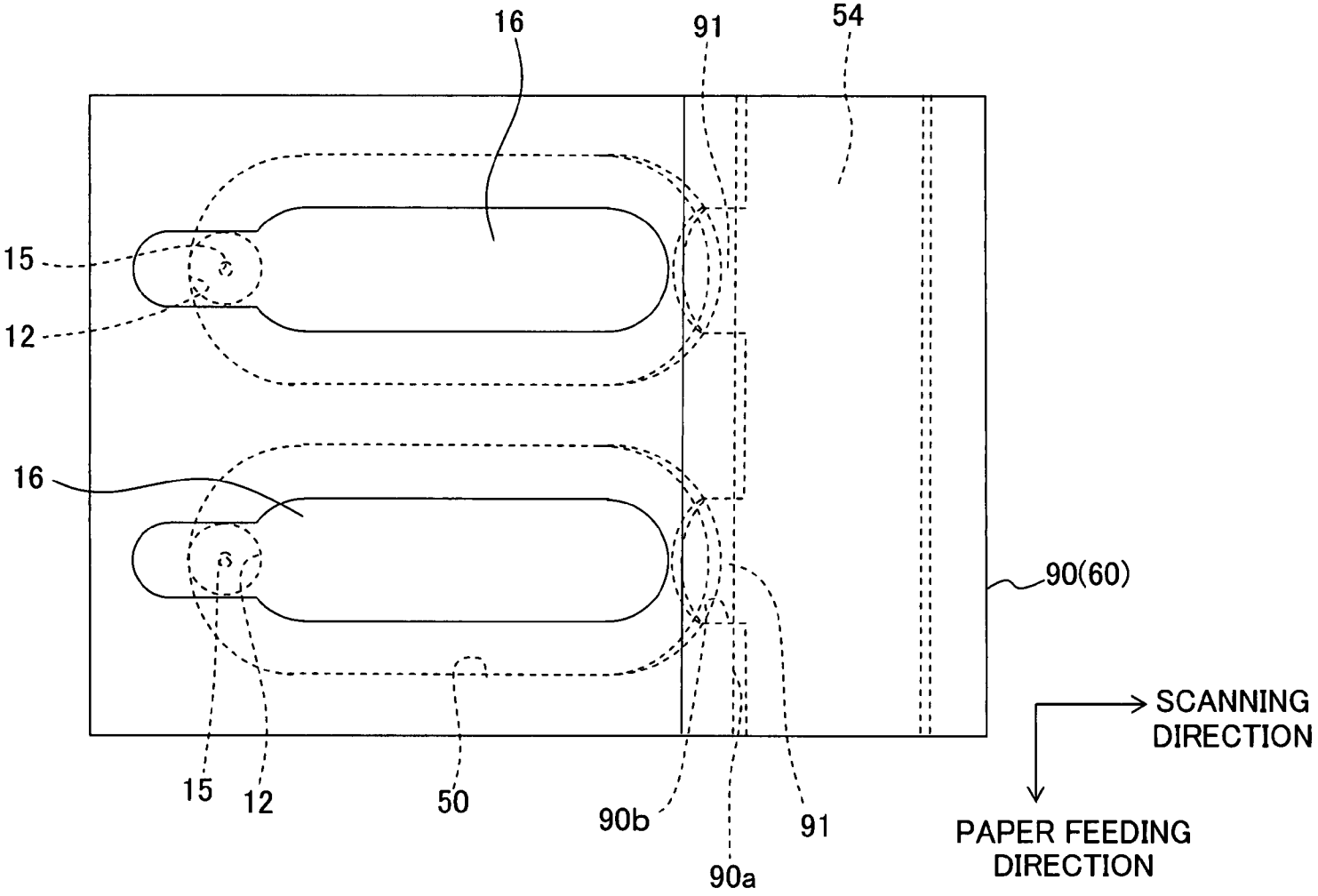
FIG. 13 is a plan view corresponding to FIG. 11 of a sixth modified embodiment.

As shown in FIG. 13, in a vibration plate 90, a recess 90*a* may include 10 recesses (communicating recesses) 90*b* which are extended from the area facing the two manifolds 54 up the area facing five pressure chambers 50 adjacent to each manifold 54. In this case, a throttle channel 91 is formed between each of the 10 recesses 90*b* and the cavity plate 60, and in the area between the adjacent recesses 90*b*, the vibration plate 90 is joined to one of the surfaces of the channel unit 31, in other words, joined to the upper surface of the cavity plate 60. Accordingly, in the area between the adjacent recesses 90*b*, the vibration plate 90 being joined to the upper surface of the cavity plate 60, when the vibration plate 90 is deformed, the fluctuation (change) in the channel area of the throttle channel 91 between the recess 90*b* and the cavity plate 60 can be suppressed, and the changing of the jetting characteristics of ink can be prevented.

Seventh Modified Embodiment

Figure 14:
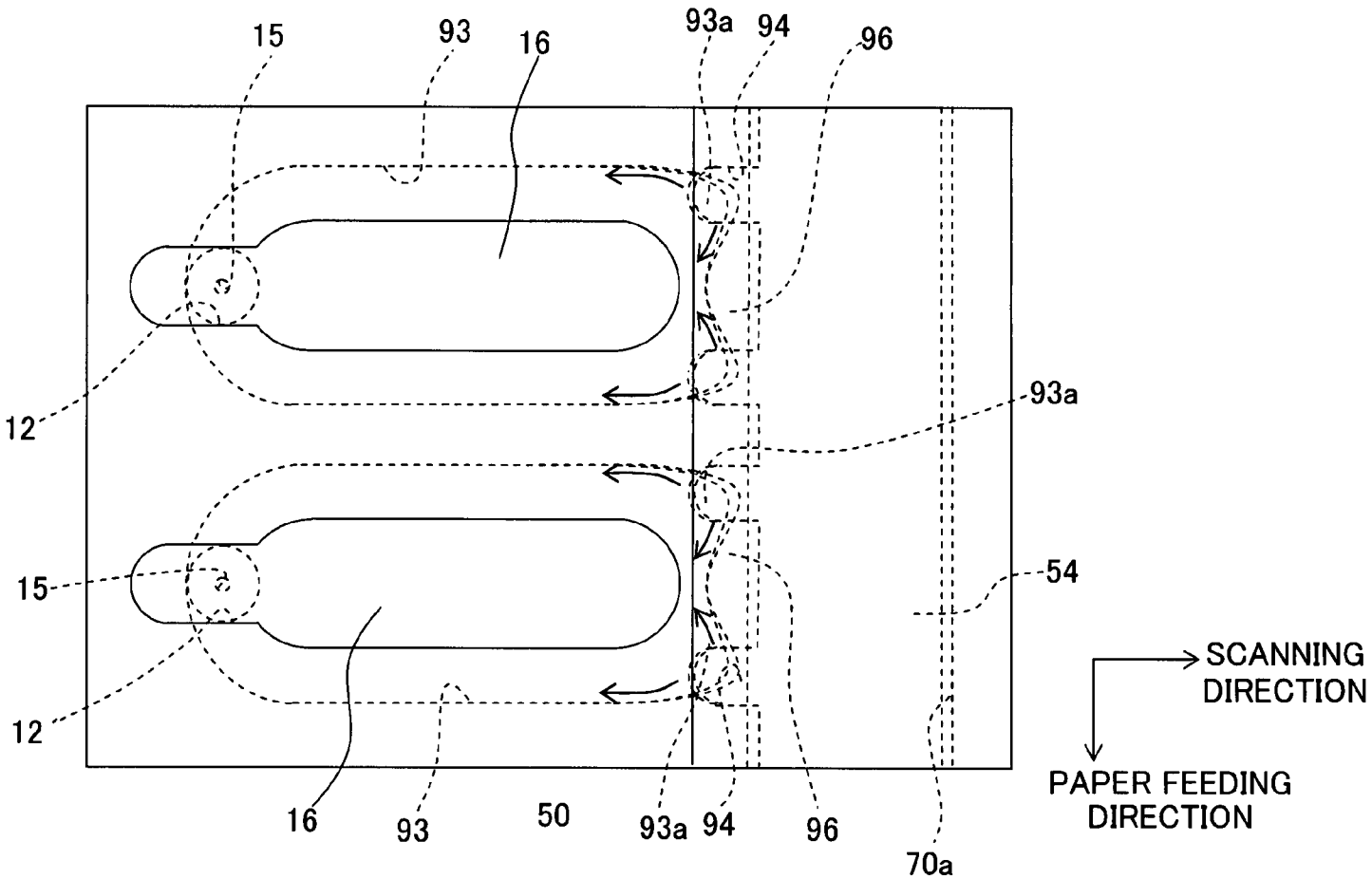
FIG. 14 is a plan view corresponding to FIG. 11 of a seventh modified embodiment.
Figure 15:
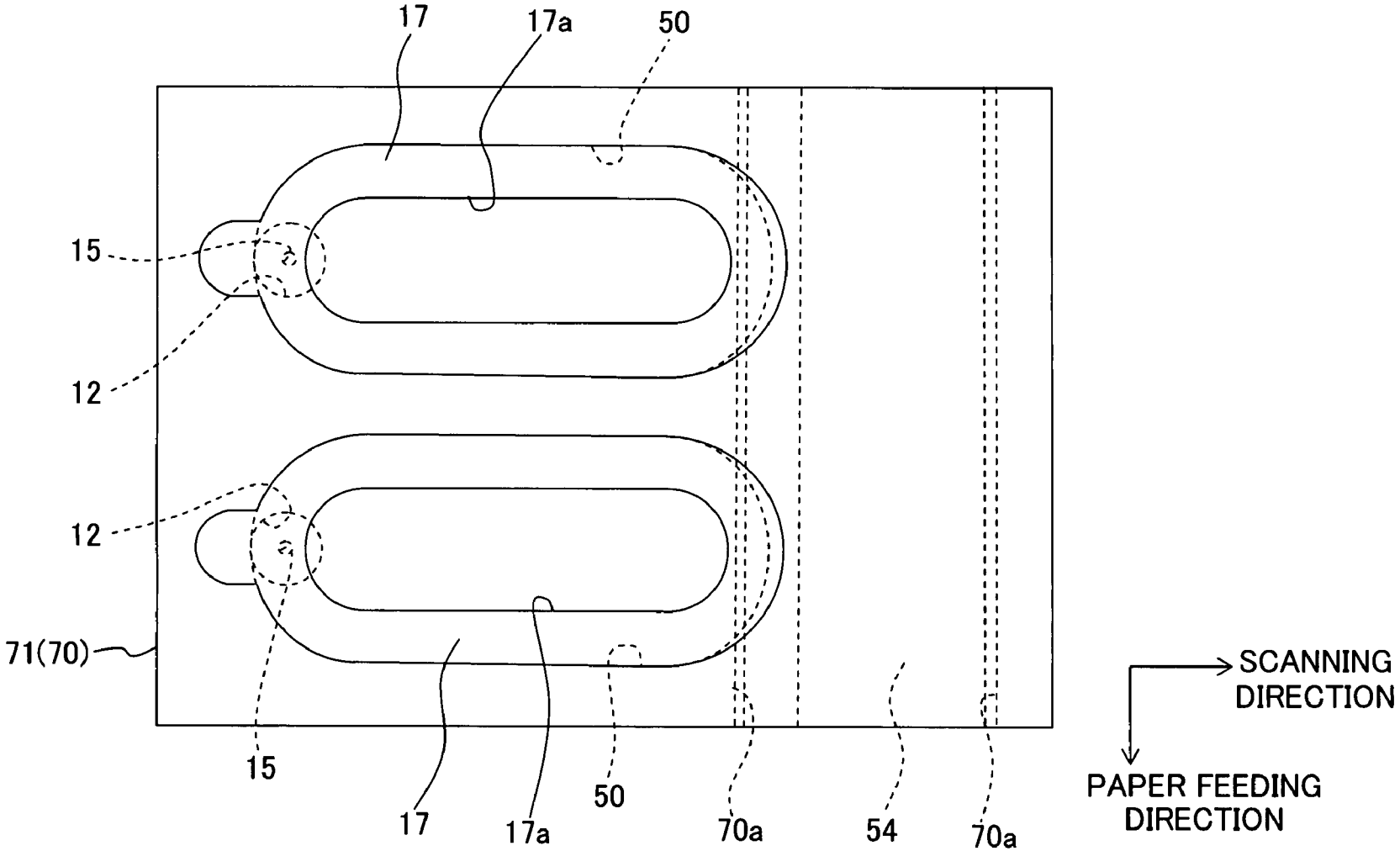
FIG. 15 is a plan view corresponding to FIG. 11 of an eighth modified embodiment.

As shown in FIG. 14, two recesses (communicating recesses) 94 may be formed corresponding to each pressure chamber 93, in a vibration plate 95, and there may exist a partition wall 96 between two ink inflow areas 93*a* corresponding to the two recesses 94 of the pressure chamber 93. In this case, the two recesses 94 extending in the scanning direction (left and right direction in FIG. 14), from the area facing the manifold 54 up to an area of each pressure chamber 93 facing both end portions in a short axis direction, are provided for each pressure chamber 93, on a lower surface of the vibration plate 95. By forming of the two recesses 94, the two ink inflow areas 93*a* into which the ink inflows separately from the manifold 54, are formed in two areas which overlap with the two recesses 94 in the longitudinal direction of each pressure chamber 93, of and end portion of a side adjacent to the manifold 54. Further, the two ink inflow areas 93*a* are partitioned by the partition wall 96. Moreover, a central portion in a short axis direction of the pressure chamber, of a side surface of the partition wall 96 is projected toward the pressure chamber 93.

When the partition wall 96 does not exist between the two ink inflow areas 93*a*, the ink is susceptible to be stagnated between the two ink inflow area 93*a*, and there is a possibility of an air bubble staying in this area. However, in this case, since the partition wall 96 exists between the two ink inflow areas 93*a*, the air bubble can be prevented from staying between the two ink inflow areas 93*a*. In this case, the side surface of the partition wall 96 on the side of the pressure chamber 93 is projected (more and more) toward an inner side (toward the center of the pressure chamber 93) in the longitudinal direction, of the pressure chamber 93, as much as the inner side in the short axis direction of the pressure chamber 93. Therefore, the ink flowed from the manifold 54 into the ink inflow area 93*a*, via the two recesses 94 flows along a wall surface inside the pressure chamber 93, and along a side surface of the partition wall 96, on the side of the pressure chamber 93.

Eighth Modified Embodiment

The shape of the individual electrode is not restricted to be a shape of the a first and second individual electrodes 16 (refer to FIG. 3 and FIG. 11), and may be an annular shape (ring shape), wherein a hole 17*a* is formed at a central portion of an individual electrode 17 in an elliptical shape slightly smaller than the pressure chamber 50. In this case, when the drive voltage is applied to the individual electrode 17 by the driver IC via the FPC, an area of a piezoelectric layer 71, facing the individual electrode 17 is contracted in the longitudinal direction of the pressure chamber 50. When the area of the piezoelectric layer 71 is contracted, the vibration plate 70 is deformed to form a projection on a side opposite to the pressure chamber 50. Accordingly, the volume of the pressure chamber 50 is increased and the pressure on the ink is reduced. Therefore, the ink is flowed from the manifold 54 into the pressure chamber 50. When the drive voltage applied to the individual electrode 17 is released, the deformation of the vibration plate 70 comes to an original state (the deformed vibration plate regains an original state). Accordingly, the volume of the pressure chamber 50 comes to the original volume, and the pressure on the ink is increased. Therefore, the ink is jetted from the nozzle 15.

Ninth Modified Embodiment

Figure 16:
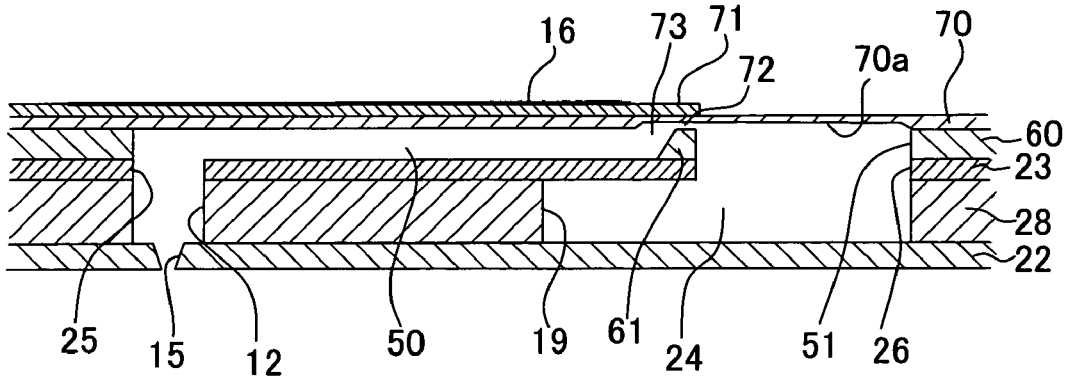
FIG. 16 is a plan view corresponding to FIG. 4 of a ninth modified embodiment.

In the first embodiment and the second embodiment, the manifold and the pressure chamber are arranged not to overlap completely (perfectly) in the plan view. However, a portion of the manifold and the pressure chamber may overlap (the manifold and the pressure chamber may overlap partially). For example, as shown in FIG. 16, a through hole formed in a manifold plate 28 may be further extended from an area facing the through hole 51, up to an area overlapping with the pressure chamber 10, and a base plate 23 formed a through hole 25 formed in an area facing the communicating hole 12 and a through hole 26 formed in an area facing the through hole 11 may be arranged between the cavity plate 60 and the manifold plate 28. In this case, a manifold 24 and the pressure chamber 50 are partitioned by the base plate 23 in the area in which the manifold 24 and the pressure chamber 50 overlap.

Tenth Modified Embodiment

In the first embodiment and the second embodiment, the recess is formed only in the area of the vibration plate, facing the manifold. However, a recess may be formed also in an area facing the ink supply channel, in addition to the area of the vibration plate facing the manifold. In this case, the vibration plate is even more susceptible to deformation, and the pressure wave can be attenuated even more effectively.

In addition, even in the second embodiment, various modifications are possible. The modifications include modifications such as providing the common electrode separately apart from the vibration plate 70 as described in the second modified embodiment (refer to FIG. 7), providing the piezoelectric layer 71 on the entire upper surface of the vibration plate 70 as described in the fourth modified embodiment (refer to FIG. 9), and providing the piezoelectric layer 71 on the entire upper surface of the vibration plate 70, and forming the grooves which are extended in the paper feeding direction, in the area of the piezoelectric layer 71, facing the manifold 54, as described in the fifth modified embodiment (refer to FIG. 10). Moreover, in the embodiments and the modified embodiments described above, the recess was formed on one of the surfaces of the vibration plate, in the portion facing the common liquid chamber. However, a member, in which the recess is formed, is not restricted to the vibration plate. For example, the recess may be formed in any plate such as an electrode plate, which is arranged on one of the surfaces of the channel unit, covering the pressure chambers.

The present invention, apart from being applicable to the ink-jet head, is also applicable to a liquid-droplet jetting apparatus which jets a liquid other than ink, such as a reagent, a biomedical solution, a wiring-material solution, an electronic-material solution, for a cooling medium (refrigerant), and for a fuel, and to a liquid transporting apparatus which transports such solutions.

What is claimed is:

1. A liquid-droplet jetting apparatus which jets a liquid in a form of liquid droplets, comprising:

a channel unit which includes a plurality of nozzles, a plurality of pressure chambers arranged on a plane, and which communicates with the nozzles respectively, and a common liquid chamber which communicates with the pressure chambers; and a piezoelectric actuator which changes selectively a volume of the pressure chambers to apply a pressure to the liquid in the pressure chambers;

the piezoelectric actuator including:

a plate arranged on a surface of the channel unit such that the plate covers the pressure chambers, a piezoelectric layer arranged on a surface of the plate at an area facing the pressure chambers, the surface being on a side opposite to the pressure chambers, a plurality of individual electrodes arranged on one surface of the piezoelectric layer, at areas each of which faces one of the pressure chambers, and a common electrode arranged on other surface of the piezoelectric layer;

wherein a portion of the common liquid chamber and the pressure chambers are arranged adjacently on said plane such that there is no overlapping area between the portion and the pressure chambers in the plane;

the plate is extended from an area facing the pressure chambers up to an area facing the portion of the common liquid chamber; and a recess is formed in a portion of the plate facing the portion of the common liquid chamber.

2. The liquid-droplet jetting apparatus according to claim 1, wherein the common liquid chamber and the pressure chambers is arranged adjacently without overlapping, when viewed from a direction orthogonal to the plane.

3. The liquid-droplet jetting apparatus according to claim 2, wherein the recess is formed on a surface of the plate, on a side of the common liquid chamber.

4. The liquid-droplet jetting apparatus according to claim 3, wherein a cross-sectional shape of the recess is tapered toward a side opposite to the common liquid chamber.

5. The liquid-droplet jetting apparatus according to claim 3, wherein:

the recess is extended from the area facing the common electrode up to an area partially facing each of the pressure chambers; and a throttle channel, in which a channel area between the common liquid chamber and each of the pressure chambers becomes partially narrow, is formed between the recess and the one surface of the channel unit.

6. The liquid-droplet jetting apparatus according to claim 5, wherein:

a partition wall which partitions the common liquid chamber and each of the pressure chambers, is formed between the common liquid chamber and each of the pressure chambers;

the throttle channel is formed between the partition wall and the recess formed in the plate; and a surface of the partition wall on a side of each of the pressure chambers is formed to be inclined toward each of the pressure chambers in a direction away from the plate.

7. The liquid-droplet jetting apparatus according to claim 5, wherein:

the recess includes a plurality of communicating recesses each of which is formed to be extended from the area facing the common liquid chamber up to the area facing one of the pressure chambers, and each of which forms the throttle channel between one of the communicating recess and the surface of the channel unit; and the plate is joined to the one surface of the channel unit at an area between the communicating recesses.

8. The liquid-droplet jetting apparatus according to claim 7, wherein:

two communicating recesses, included in the communicating recesses and corresponding to each of the pressure chambers, are provided to the plate; and each of the pressure chambers includes two liquid inflow areas which communicate separately with the two communicating recesses respectively, and the partition wall is formed between the two liquid inflow areas.

9. The liquid-droplet jetting apparatus according to claim 2, wherein:

the recess is formed as a plurality of individual recesses lined up in one predetermined direction, in a portion of the plate facing the common liquid chamber; and the individual recesses are formed alternately on a surface of the plate on the side of the common liquid chamber, and on the other surface of the plate on a side opposite to the common liquid chamber.

10. The liquid-droplet jetting apparatus according to claim 2, wherein the piezoelectric layer is formed on the plate at an area excluding the portion facing the common liquid chamber.

11. The liquid-droplet jetting apparatus according to claim 2, wherein:

the piezoelectric layer is formed continuously from a portion of the plate facing the pressure chambers, up to the portion of the plate facing the common liquid chamber; and one of a groove and a hole is formed in a portion of the piezoelectric layer facing the common liquid chamber.

12. A liquid transporting apparatus which transports a liquid, comprising:

a channel unit which includes a plurality of pressure chambers arranged on a plane, a common liquid chamber which communicates with the pressure chambers, and a piezoelectric actuator which changes selectively a volume of the pressure chambers to apply a pressure to the liquid in the pressure chambers;

the piezoelectric actuator including:

a plate arranged on one surface of the channel unit such that the plate covers the pressure chambers, a piezoelectric layer arranged on a surface of the plate at an area facing the pressure chambers, the surface being on a side opposite to the pressure chambers, a plurality of individual electrodes arranged on one surface of the piezoelectric layer at areas each of which faces one of the pressure chambers, and a common electrode arranged on other surface of the piezoelectric layer;

wherein a portion of the common liquid chamber and the pressure chambers are arranged adjacently on said plane such that there is no overlapping area between the portion and the pressure chambers in the plane;

the plate is extended from an area facing the pressure chambers, up to an area facing the portion of the common liquid chamber; and a recess is formed in a portion of the plate facing the portion of the common liquid chamber.

13. The liquid transporting apparatus according to claim 12, wherein:

the pressure chambers and the common liquid chamber are arranged adjacently without overlapping, when viewed from a direction orthogonal to the plane.

* * * * *